United States Patent [19]

Pezzoli

[11] Patent Number: 4,877,064

[45] Date of Patent: Oct. 31, 1989

[54] DEVICE FOR THE AUTOMATIC CONTROL OF THE WEFT YARN FEED IN AIR LOOMS

[75] Inventor: Luigi Pezzoli, Leffe, Italy

[73] Assignee: Vilminore Officine Meccaniche S.P.A., Vilminore Di Scalve, Italy

[21] Appl. No.: 147,310

[22] Filed: Jan. 22, 1988

[30] Foreign Application Priority Data

Jan. 26, 1987 [IT] Italy ..... 19157 A/87

[51] Int. Cl.[4] ..... D03D 47/30; D03D 47/36

[52] U.S. Cl. ..... 139/435; 139/452

[58] Field of Search ..... 139/435, 450, 452, 370.2

[56] References Cited

U.S. PATENT DOCUMENTS

| | | | |
|---|---|---|---|
| 4,446,893 | 5/1984 | Gunneman et al. | 139/435 X |
| 4,658,865 | 4/1987 | Gotoh | 139/435 |
| 4,673,004 | 6/1987 | Rosseel et al. | 139/435 |
| 4,716,941 | 1/1988 | Takegawa | 139/435 X |
| 4,759,392 | 7/1988 | van Bogaert et al. | 139/435 |
| 4,787,423 | 11/1988 | Hrus et al. | 139/435 |

FOREIGN PATENT DOCUMENTS

| | | |
|---|---|---|
| 0114047 | 7/1984 | European Pat. Off. . |
| 0189919 | 8/1986 | European Pat. Off. . |
| 2151266 | 7/1985 | United Kingdom . |
| WO84/02360 | 6/1984 | World Int. Prop. O. . |

*Primary Examiner*—Andrew M. Falik

*Attorney, Agent, or Firm*—Young & Thompson

[57] ABSTRACT

A device for the automatic control of the weft yarn feed in air looms which includes a weft yarn feeder and sensors to sense the time required for each turn of the weft yarn leaving the feeder to unwind. The sensors generate a signal which is received by an analysis circuit associated with a programmable control circuit which controls the feeding of the weft yarn. The feeding of the yarn can be varied based on differences in the physical characteristics of the yarn which effect the operation of the loom.

7 Claims, 5 Drawing Sheets

DEVICE FOR THE AUTOMATIC CONTROL OF THE WEFT YARN FEED IN AIR LOOMS

BACKGROUND OF THE INVENTION

This invention relates to a device for the automatic control of the weft yarn feed in air looms.

It is known that the proper working of air looms—in which the weft yarns are inserted into the shed and conveyed through the same by means of air blasts blowing from nozzles suitably arranged upstream of the loom, along the shed and downstream of the loom—greatly depends on the constancy of the physical characteristics of the yarn. In fact, any fluctuations in said characteristics tend, above all, to easily produce a variation in the "flight" time of the weft yarn. Assuming that the setting of looms is optimized for a short "flight", any variations in said physical characteristics of the yarn, leading to unexpected longer "flights", lead to a lengthening of the cycle time with the possibility of machine stoppage. Whereas, if the loom is set for a long "flight" (in practice, one should vary the feed pressure of the main nozzle and/or of the auxiliary nozzles), it is possible to avoid stoppage under the previously specified conditions, but the result is a greater, undesired and unnecessary energy consumption, should the yarn conditions subsequently allow shorter flight times. In any case, there is the possibility of defects appearing in the finished fabric.

On the other hand, maintaining the physical characteristics of a yarn constant is a purely theoretical characteristic, as the said fluctuations practically occur in all yarns, even if to an obviously greater or lesser extent according to the type and quality of the yarn. It is therefore extremely important that the working of air looms should not be limited by these fluctuations and this can be achieved by modifying the operation of the loom based on the characteristics of the yarn being woven, so that the drawbacks deriving from the inconsistency of its physical characteristics may be eliminated or at least greatly reduced.

An attempt in this respect has already been made in the past (see for example the W.O. publication No. 84/02360) by determining, through sensors, the time taken for each yarn turn (or turn section) leaving the feeder to unwind, and by setting, accordingly to the determined values, the operating periods—which may continuously vary—of the single nozzles. This process has however the disadvantage of requiring the insertion of the single wefts at times differing from that programmed for the proper working of the loom and also differing one from the other, which may cause serious defects in the fabric.

Furthermore, due to the technical operating times of the solenoid valves and to the high loom speeds, it is not easy to obtain the desired automatic control.

SUMMARY OF THE INVENTION

The present invention by contrast operates under the principle of establishing a specific loom working program to which there corresponds certain characteristic parameters (operating periods, strength and length of the air blasts blowing from the single nozzles), and suitably modifying these parameters any time the weft yarn characteristics changes in respect of those programmed, so as to obtain a yarn feeding equivalent to that which would have been obtained on the basis of the programmed information and, consequently, a proper automatic control of said feeding.

For this purpose, the present invention concerns a device for the automatic control of the weft yarn feed in air looms, of the type in which the yarn—supplied at one end of the loom by a known type feeder which draws it from a spool—is inserted into the loom by a drawing-in nozzle upstream of the loom, is conveyed along the shed by a set of feed nozzles (or secondary nozzles) within the shed, and is placed under tension by a tensioning nozzle downstream of the loom, said nozzles connected to compressed air receivers through solenoid valves, controlled by a control circuit having the ability to be programmed both based on the variables that effect the operating times and the pressure fed to said valves, characterized in that, in connection with said programmable control circuit there is associated a circuit capable of collecting and analyze the signals sent from one or more sensors which determine the time taken for each yarn turn or turn section leaving the feeder to unwind, said circuit influencing the programmable control circuit in order to vary the programmed working parameters.

A device of this type also allows to be conserved since energy, the circuit has the ability to influence the programmable control circuit any time a specific high production standard has been achieved, so as to permit said parameters to be varied insofar as limiting the length and strength of the air blasts blowing from the single nozzles.

BRIEF DESCRIPTION OF THE DRAWINGS

The invention is described hereinafter in further detail, by reference to the accompanying drawings, which represent some preferred embodiments thereof and in which.

DESCRIPTION OF THE PREFERRED EMBODIMENTS

Figure 1:
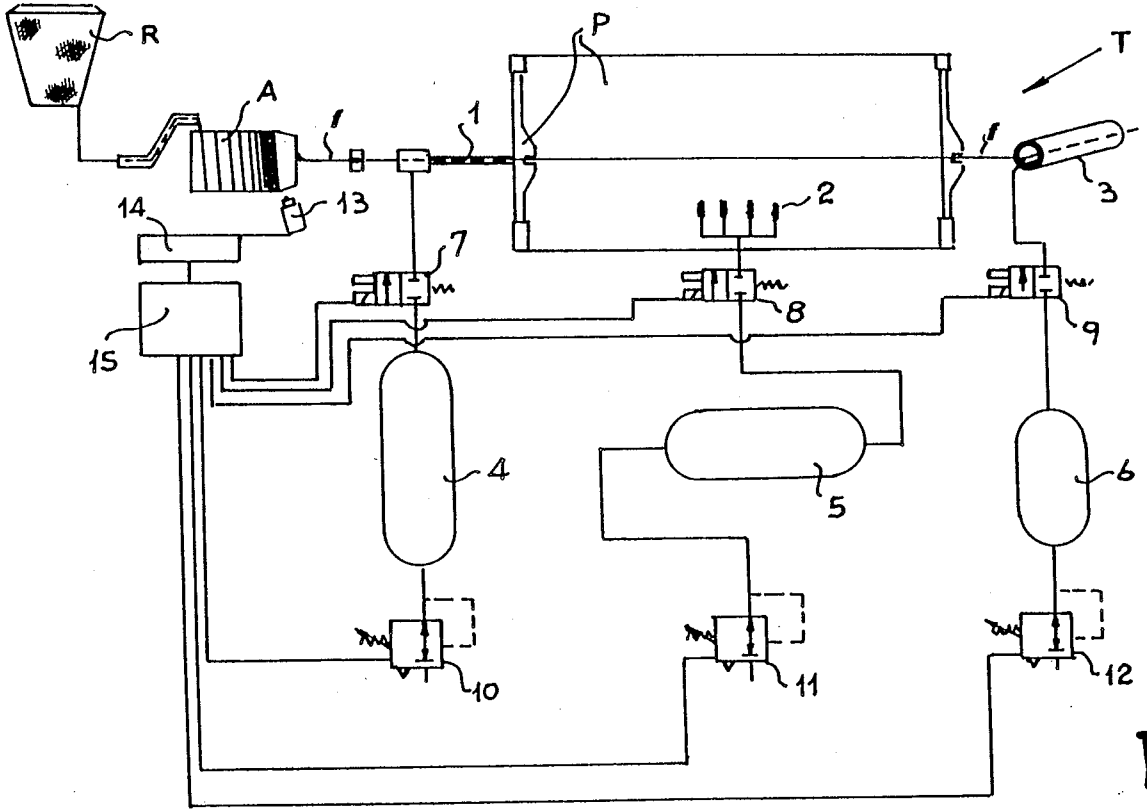
FIG. 1 is a schematic diagram of a first embodiment of the device according to the invention, applied to an air loom.

The drawings show the device according to the invention applied to an air loom T, of which the reed and sley P, the nozzle 1 drawing in the yarn f, the set of feed nozzles 2, and the tensioning nozzle 3, are shown diagrammatically. Said nozzles are fed from compressed air receivers 4, 5 and 6 (i.e., air supply means) respectively, through solenoid valves 7, 8 and 9, the pressure in the receivers being regulated by means of servo controls 10, 11 and 12. The yarn f is supplied to the nozzle 1 by a conventional weft feeder A which draws it from a spool R.

The device according to the invention, represented by the diagram of FIG. 1, comprises an optical or piezoelectric sensor 13, connected to a system and analysis circuit 14. The unit 13, 14, determines the time taken for each yarn turn leaving the feeder A to unwind (before the rotary-translational motion of the yarn, as it emerges from the feeder A, is turned into a purely translational motion, as said yarn is drawn into the loom T). The circuit 14 is associated—according to the invention—with a programmable control circuit 15, to which it transmits its analysis signals. From the circuit 15—prearranged for a specific preestablished working program of the loom T, to which there correspond certain characteristic parameters (operating periods, strength and length of the air blasts)—output signals are sent both to the solenoid valves 7, 8 and 9, and to the servo controls 10, 11 and 12, in order to operate the same according to the program.

As a result of the analysis provided by the circuit 14, it is possible to continuously vary this program throughout loom operation, according to the times taken for the turns of yarn f to unwind, as determined by the sensor 13 and depending on the yarn's physical characteristics. This allows both the blowing periods and times of the nozzles 1, 2 and 3 to be varied as well as, the air pressures in the receivers 4, 5 and 6, so as to obtain yarn feed conditions permitting the insertion of the weft yarn in an optimal time, independently of any changes in the physical characteristics of the yarn itself, which directly influence its unwinding speed on leaving the feeder A, said speed corresponding to the times determined by the sensor 13.

Figure 2:
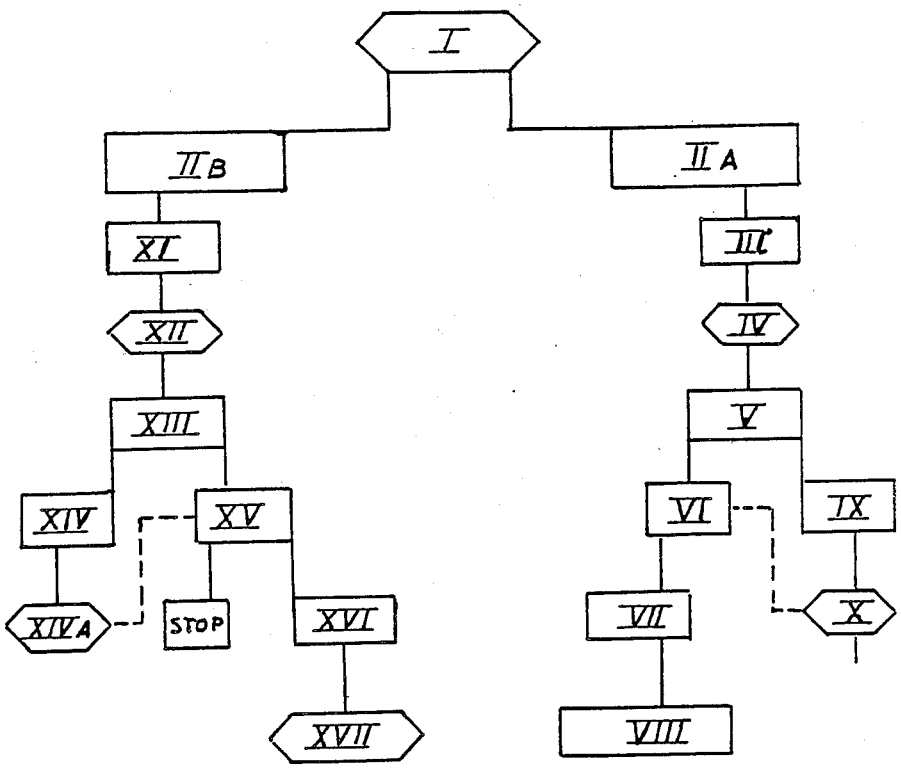
FIG. 2 is a flow diagram illustrating in detail the logic control of said device by the programmable control circuit and by the sensing and analysis circuit of the device itself.

The logic adopted is that illustrated in detail in FIG. 2 and specified hereinafter.

Figure 5:
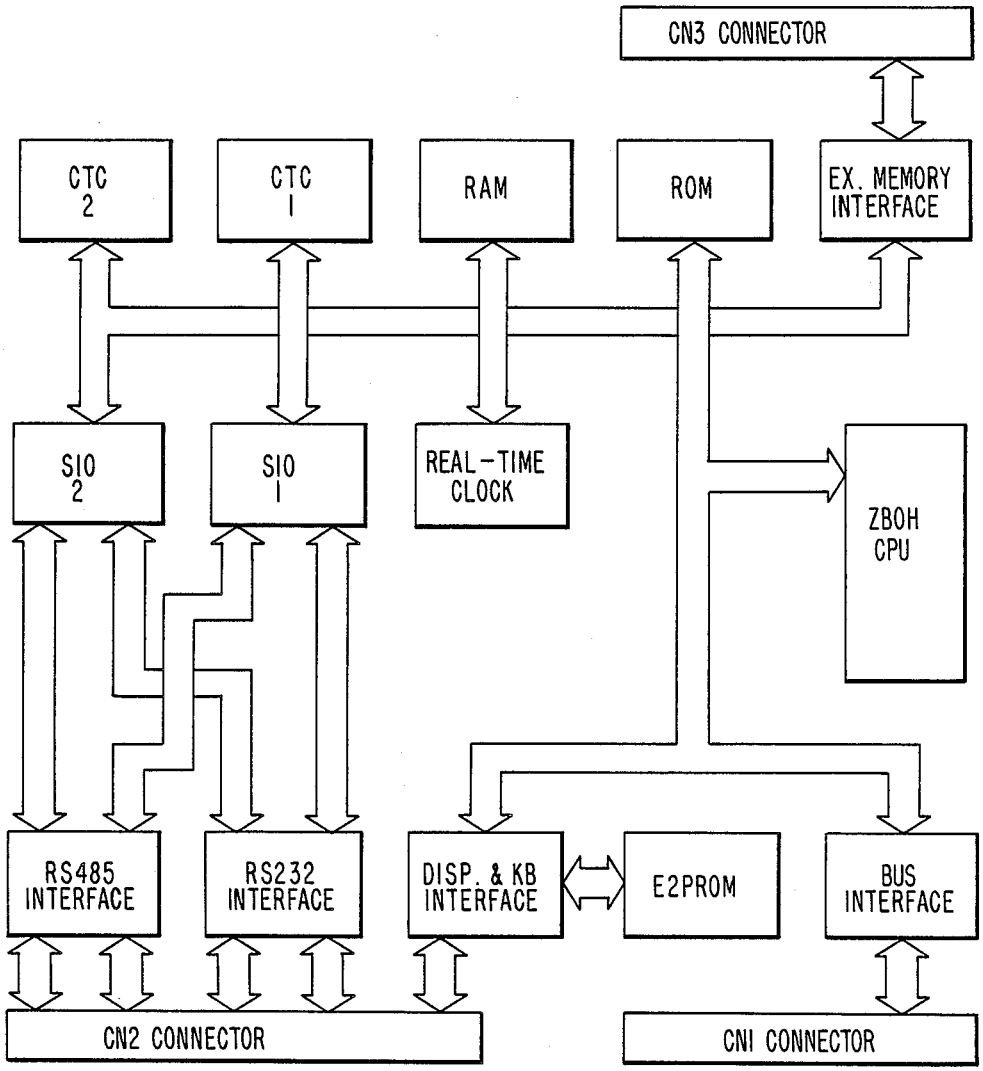
FIG. 5 is a diagram of the analyzing circuit.

Once the loom T is started (I), the analysis circuit 15 shown in FIG. 5 verifies whether the loom is maintaining the programmed productivity (II).

In the event the programmed productivity is not maintained (IIA), the sensor 13 determines the yarn turns unwinding times (III), compares them to the programmed standard times, stores them in the memory, and transmits to the circuit 15 the results of the analysis. A change of program (IV) takes place in the circuit 15, able to compensate for the negative characteristics of the yarn, so as to equally achieve a total time of weft insertion into the shed as close as possible to the optimal time.

In practice, this will affect the strength and length of the single air blasts and the operating periods of the single nozzles.

At this point, the sensor 13 again determines the unwinding times (V) and calculates whether they are acceptable. It will of course be understood that this corrected unwinding time (V) will be closer to the optimal time than was the previous unwinding time (III) because the change of program (IV) has intervened. In the event said times are acceptable (VI), the process stops (VII) and the adjustment carried out is stored in the memory (VIII) for a definite length of time. This information can be processed separately so as to study the concomitant causes which have led to the adjustment and take them into account for the best programs of the weaving operation.

Whereas, if the yarn turns unwinding times are not acceptable (IX), operations IV and V are repeated (X) until such times become acceptable.

Also in the event the programmed productivity should be maintained (IIB), the sensor 13 determines the yarn turns unwinding times (XI), compares them to the programmed standard times, stores them in the memory, and transmits to the circuit 15 the results of the analysis. In this case, however, there is a change of program (XII) in the circuit, able to verify (XIII) whether, by reducing the strength and length of the air blasts and/or varying the operating periods thereof (XIV), it is possible to achieve the same total time of weft insertion as in the previous case.

If said time has remained unvaried, operations XII and XIII are repeated (XIVA) with further reductions and changes in the aforespecified parameters, until the time varies (XV). At this point, an inversed change is operated (XVI), more minor than the previous one, and the total weft insertion time is determined once more before stopping the process (STOP) which provides for a final storage in the memory (XVII) for known purposes.

With the device according to the invention it is thus possible to to prevent the yarn feed drawbacks resulting from fluctuations in the physical characteristics of the yarn, with considerable advantages both for the progress of weaving operations (which take place more regularly and with less energy and yarn consumption) and for improving the quality of the product obtained.

Figure 3:
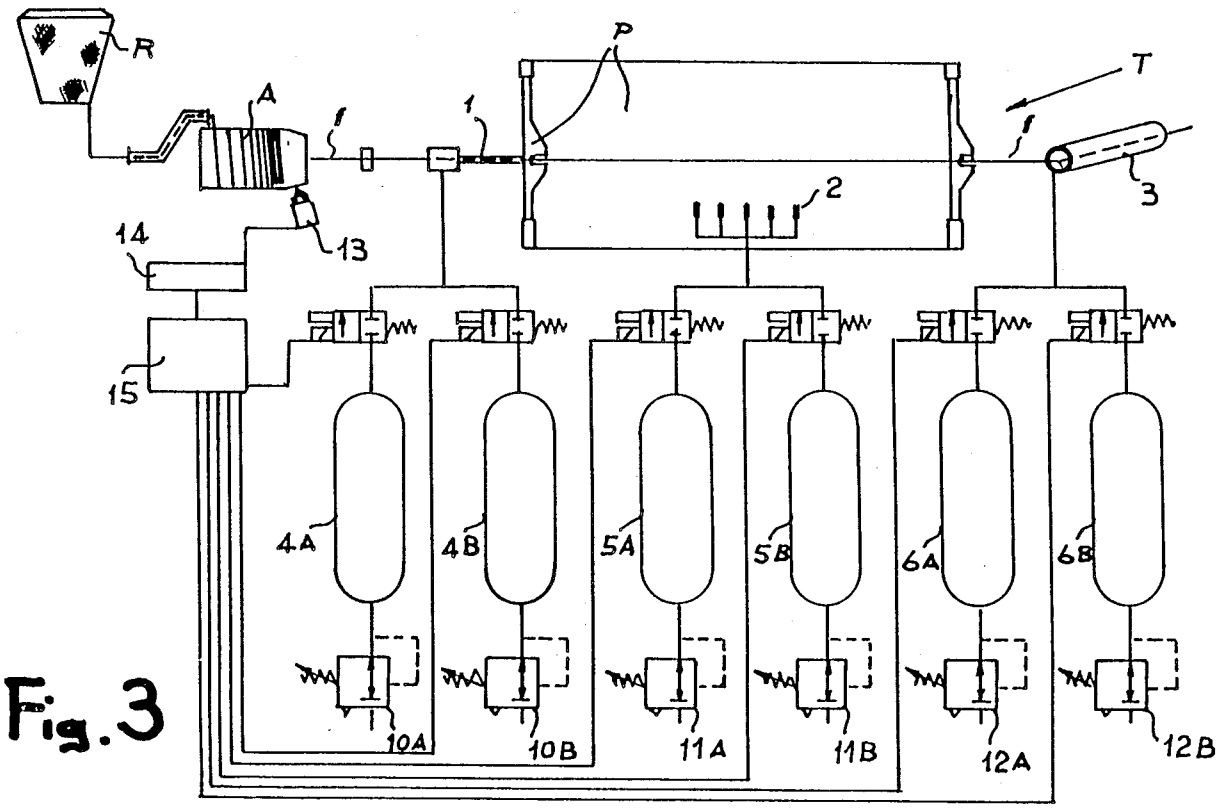
FIGS. 3 and 4 are diagrams similar to that of FIG. 1, corresponding to two different embodiments of the device according to the invention.
Figure 4:
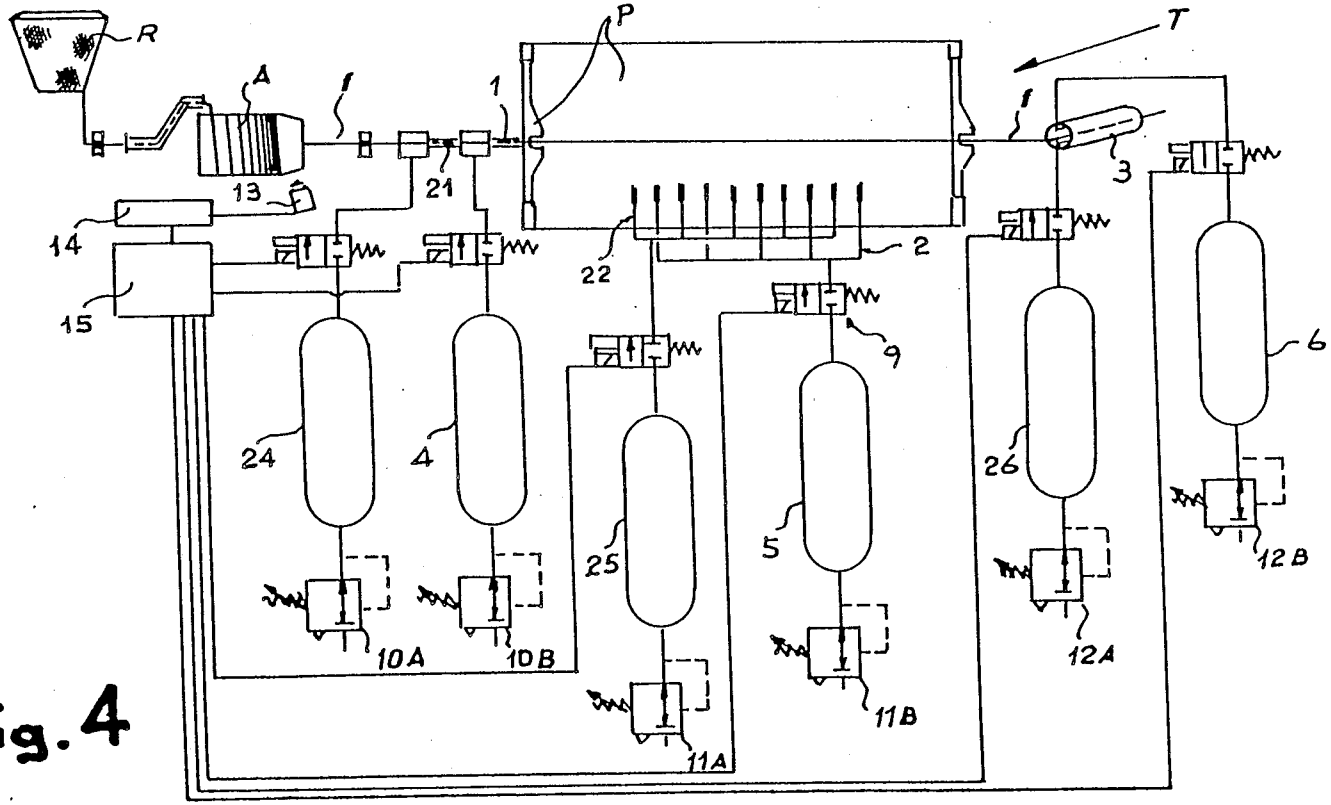

The automatic control device according to the invention can also be realized in other embodiments differing from that illustrated in FIG. 1. First of all, instead of a single sensor 13, more sensors (not shown) can be used, evenly or unevenly distributed at the periphery of the drum of the feeder A. In this case, each sensor monitors only one section of each yarn turn unwinding from the feeder and thus determines the unwinding times of said yarn turn sections. In addition, as can be seen in the embodiment of FIG. 3, the nozzles 1, 2 and 3 can be connected to pairs of compressed air receivers 4A, 4B, 5A, 5B and 6A, 6B, having different pressure levels, each with its own solenoid valve and servo control. In the embodiment of FIG. 4, to the ordinary nozzles 1 and 2, connected to the air receivers 4 and 5, there are furthermore associated supplementary nozzles 21 and 22, connected to additional air receivers 24 and 25, these also including their own solenoid valve and servo control, and a supplementary air receiver 26 is added for the nozzle 3.

If the loom is supplied with several yarns of different colors, which require the nozzles to have different blowing times or to be fed with air at different pressure levels, the automatic control device according to the invention can also be employed by simply supplying to the programmable control circuit 15—suitably adapted—the data relative to the color sequence involved. The circuit will accordingly adapt the air pressures and nozzle blowing times to each type of yarn, by correspondingly setting them—for color—to those values which had been set in the previous cycle for the same color (and type of yarn), such values being then adjusted—as already seen in the case of a single yarn supply—time after time, as they are picked up by the sensor 13, with the cooperation of the sensing and analysis circuit 14.

Luminous signals or panels can be employed with the described device, to allow the operators to act immediately in the event the analysis signals should reveal that the physical degradation of the yarn being woven is leading to intolerable consumption by the loom.

It is understood that the invention could also be carried out differently than in the heretofore described and illustrated embodiments. For instance, the sensor 13 of the device according to the invention—which, in the accompanying drawings, is shown separate from the feeder A—could obviously form part thereof, by being incorporated in or associated to said component. This arrangement could also be adopted in the already considered case of using several sensors. In turn, the sensing and analysis circuit 14 and the programmable control circuit 15 could be integrated into a single monitoring circuit.

I claim:

1. In an air loom, the combination comprising:

weft yarn feeding means for feeding the weft yarn from a spool;

means for moving said weft yarn through a shed of said loom, said means comprising multiple air jet nozzles or sets of nozzles blowing air along said shed from air supply means;

sensing means, positioned at the outlet of the feeding means, to sense the time required for each turn or part of a turn of said weft yarn leaving said feeding means to unwind, said sensing means generating a signal in response to said sensing;

a programmable control circuit, to control said movement of said weft yarn through said shed, which circuit supplies reference values according to predetermined weft yarn unwinding times; and comparator means, to compare said signals generated by said sensing means with said reference values and to adjust air blowing parameters of the air jet nozzles, either in response to differences existing between said compared signals and values so as to reduce said differences, or in order to obtain the most economical adjustment of said parameters which will avoid said differences.

2. Structure as claimed in claim 1, comprising also a feeder drum on which yarn from the spool is wound and from which yarn is supplied to the shed of the loom, and a plurality of sensors distributed about the periphery of the feeder drum, each sensor picking up the unwinding time of a turn section.

3. Structure as claimed in claim 1, wherein a single air supply means is provided for each of said nozzles or set of nozzles, and wherein said programmable control circuit controls, on the one hand, solenoid valves which control the flow of air to said nozzles, and, on the other hand, servo controls associated with said air supply means, in order to vary the pressure therein.

4. Structure as claimed in claim 1, wherein a pair of air receivers, having different pressure levels, are provided for each of said nozzles or set of nozzles, a solenoid valve and a servo control being associated with each air supply means, and wherein said programmable control circuit controls, on the one hand, said solenoid valves, and, on the other hand, said servo controls.

5. Structure as claimed in claim 1, wherein for each of said nozzles or set of nozzles there are provided supplementary nozzles or sets of nozzles, fed from air supply means which are separate from air supply means feeding the first mentioned nozzles or sets of nozzles and having their own solenoid valves and servo controls, and wherein said programmable control circuit controls said solenoid valves and servo controls.

6. Structure as claimed in claim 1, wherein said programmable control circuit includes means to store and process data relative to a sequence of yarns of different colors.

7. Structure as claimed in claim 6, also comprising luminous signals or panels indicating variations in the working parameters of the nozzles as they occur.

* * * * *